United States Patent [19]

Kilsdonk et al.

[11] Patent Number: 4,904,194

[45] Date of Patent: Feb. 27, 1990

[54] POLARIZED GROUNDING PIN

[75] Inventors: Jan A. Kilsdonk, Corona; Norman L. Hug, Cypress, both of Calif.

[73] Assignee: McDonnell Douglas Corporation, Long Beach, Calif.

[21] Appl. No.: 342,068

[22] Filed: Apr. 24, 1989

[51] Int. Cl.[4] ..... H01R 4/66

[52] U.S. Cl. ..... 439/101; 439/681

[58] Field of Search ..... 439/95, 101, 103, 102, 439/106, 607, 609, 680, 681

[56] References Cited

U.S. PATENT DOCUMENTS

| | | | |
|---|---|---|---|
| 3,023,394 | 2/1962 | Hubbell | 439/681 |
| 3,714,617 | 1/1973 | Bright et al. | 439/681 |
| 3,987,344 | 10/1976 | Ambruoso et al. | 439/101 X |
| 4,717,344 | 1/1988 | Schempp et al. | 439/101 X |

FOREIGN PATENT DOCUMENTS

| | | | |
|---|---|---|---|
| 745306 | 2/1956 | United Kingdom | 439/102 |

*Primary Examiner*—Eugene F. Desmond

*Attorney, Agent, or Firm*—Gregory A. Cone; George W. Finch; John P. Scholl

[57] ABSTRACT

A polarized grounding pin incorporating a spring, to provide continuous electrical conductivity between mated connector shells.

11 Claims, 4 Drawing Sheets

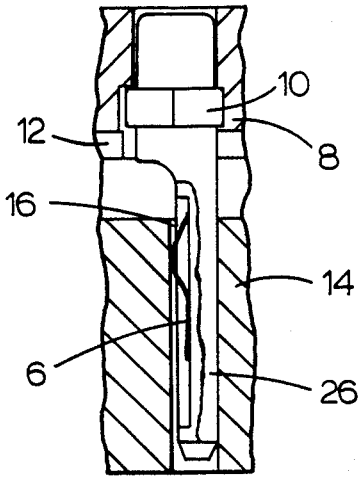
fig. 4
fig. 5a
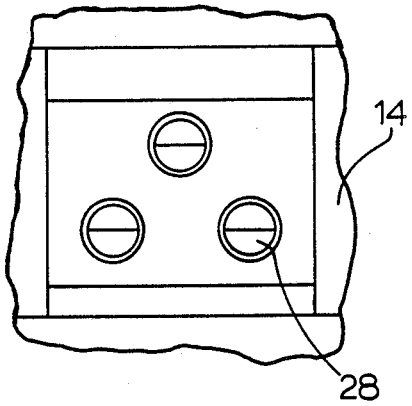
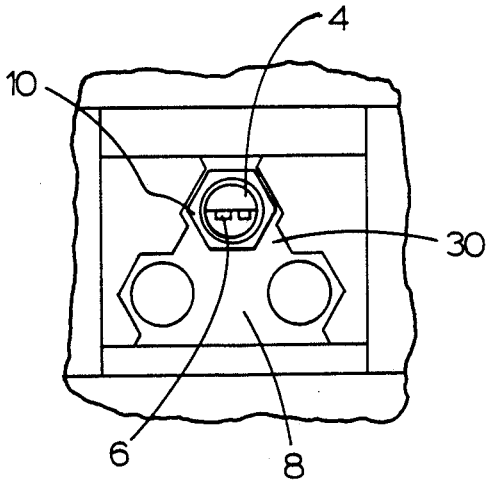
fig. 6

POLARIZED GROUNDING PIN

BACKGROUND OF THE INVENTION

When electrical connectors are mated it is desirable to have electrical conductivity between the shells of the mated connectors. Electronic "boxes" for aircraft are often grounded to the structure of the plane. This is usually accomplished by grounding the "box" to the shell of a connector which is then mated to another connector having its shell grounded to the airplane. This provides an electrical path between the "box" and the plane.

Present attempts to provide for shell to shell conductivity include attaching a garter spring around the outside of a rectangular female connector or extending wiper blades from the shell of a circular connector. Use of these designs require high insertion forces to mate the connectors. Additionally, the wiper blades or springs fail after a few mating cycles resulting in low reliability and increased maintenance. It is therefore desirable to have a simple low cost device that will produce high repeatability and can be retrofitted to existing connectors. The device should be capable of providing continuous conductivity without interruptions due to shock or vibration.

To prevent the mating of electrically incompatible connectors, a polarizing feature is incorporated into the connectors. The ARINC 404 and 600 connectors use a male connector with a tongued post having a hexagonal head, that mates with a semi-circular aperture in the female connector. The post is capable of rotation into six different positions so that the male connector will only mate with a female connector having an aperture with the same orientation as the post.

SUMMARY OF INVENTION

This invention is a grounding pin comprising a spring attached to an electrically conductive post. The pin is retained by a male connector which mates with a female connector. When the male and female connectors are mated, the pin becomes engaged with a receiving aperture in the female connector, compressing the spring, which pushes the post against the shells of the male and female connectors. The pressure exerted on the post by the spring ensures constant contact between the post and connector shells providing continuous conductivity between the shells of the male and female connectors. The grounding pin can be assembled by attaching a spring to the polarizing post of the ARINC connectors, providing existing ARINC connectors with shell to shell conductivity without requiring any modifications of the connectors themselves.

It is an object of this invention to provide continuous connector shell to connector shell conductivity without interruptions due to shock or vibration.

It is an object of this invention to provide a device creating shell to shell conductivity that is highly reliable with minimal maintenance.

It is an object of this invention to provide a device creating shell to shell conductivity that can be easily retrofitted into existing connectors.

It is an object of this invention to provide a device creating shell to shell conductivity that is low in cost and easy to assemble.

DETAILED DESCRIPTION OF THE DRAWINGS

FIG. 4 is a cross-section of a grounding pin inserted into a receiving aperture of a female connector shell.

Figure 5:
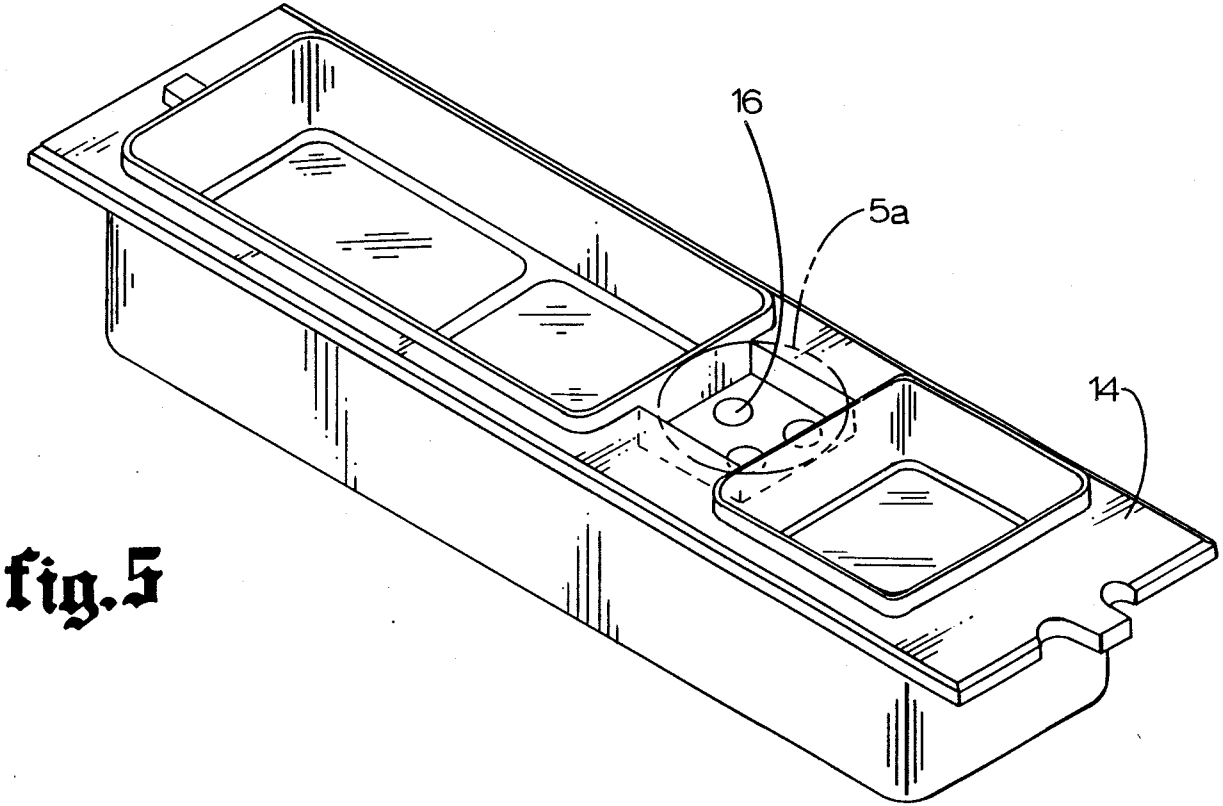
FIG. 5 is a female connector with receptive apertures.

FIG. 5*a* is an exploded view of the receptive apertures of a female connector.

FIG. 6 is a grounding pin with a polarized hexagonal collar in a male connector shell, with the pin retainer plate removed.

DETAILED DESCRIPTION OF INVENTION

Figure 1:
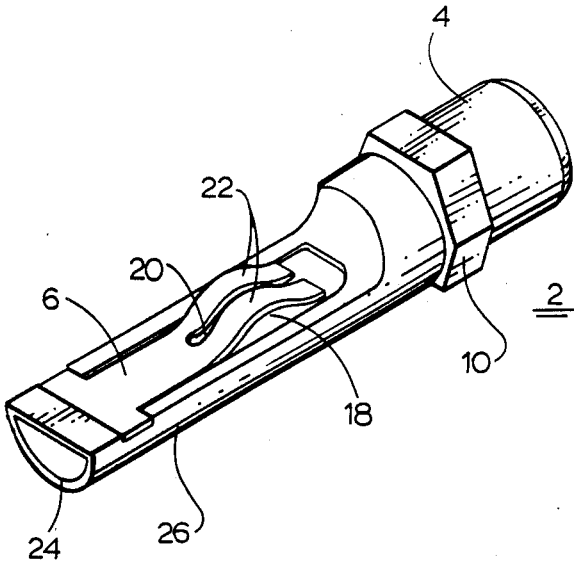
FIG. 1 is a grounding pin with a polarizing tongue.
Figure 2:
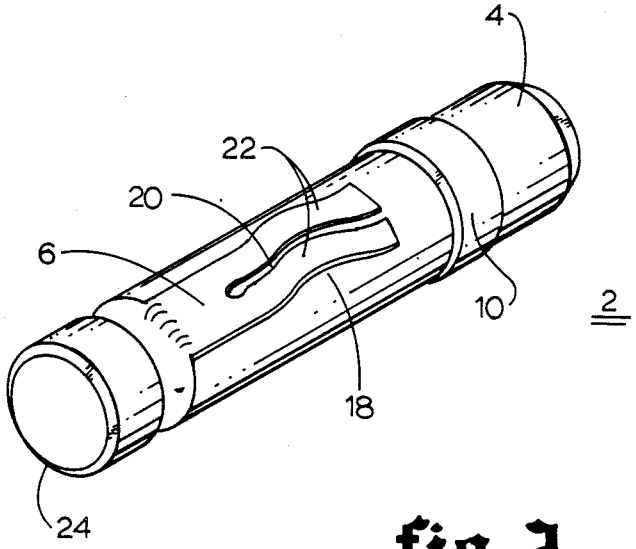
FIG. 2 is a grounding pin without a polarizing tongue.
Figure 3:
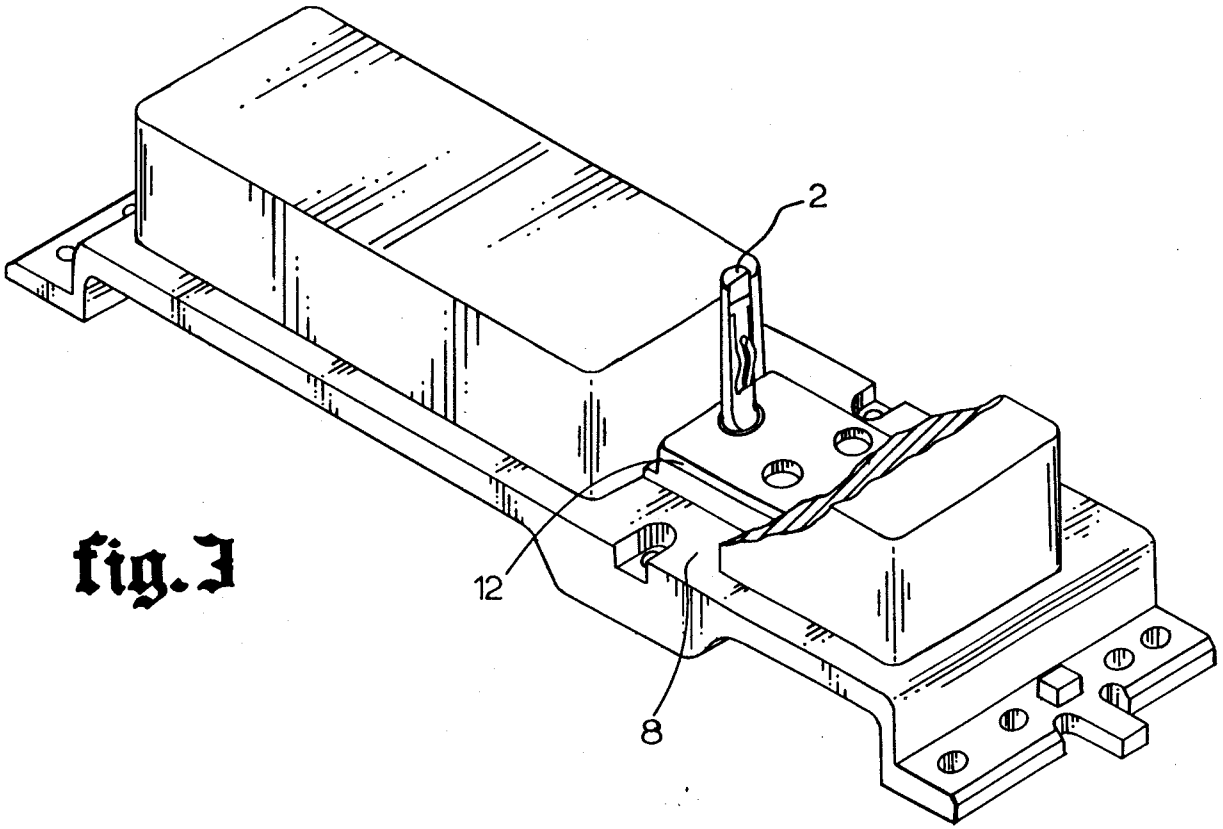
FIG. 3 is a male connector with a grounding pin.

Referring to the drawings more particularly by reference numbers, grounding pin assemblies 2 are shown in FIG. 1 and FIG. 2. The grounding pin 2 is comprised of a post 4 and a spring 6. The grounding pin 2 is retained by a male connector shell 8, see FIGS. 3 and 4. The post 4 has a collar 10 that is encapsulated between the male connector shell 8 and a retainer plate 12, that is screwed into the male connector shell 8. The male connector shell 8 mates with a female connector shell 14. The female connector shell 14 has an aperture 16 for receiving the grounding pin 2, FIG. 5. Each pair of mating connectors 8 and 14 may have more than one grounding pin 2 and receiving aperture 16.

When the male connector shell 8 is mated with the female connector shell 14, the spring 6 comes in contact with the female connector shell 14 at the circumference of the second aperture 16, see FIG. 4. The spring 6 has a outwardly convex portion 18 that combines with the post 4 to have an overall dimension larger than the second aperture 16. When the grounding pin 2 is inserted into the second aperture 16 the outwardly convex portion 18 of the spring 6 compresses, exerting a force on the post 4, pushing the post 4 against the female connector shell 14, see FIG. 4. The spring 6 also pushes the collar 10 against the male connector shell 8, creating positive contact between the post 4 and shells 8 and 14 which provides maximum conductivity. The force exerted by the spring 6 keeps the post 6 in contact with the shells 8 and 14 at all times ensuring continuous conductivity without interruptions due to shock or vibration.

The spring 6 can be attached to the post 4 by mechanical attaching means such as, brazing, tap welding or slip fitting, the spring 6 to the surface of the post 4. The spring 6 can be made from a flexible material such as hardened beryllium copper, with the outwardly convex portion 18 having a slot 20 which forms two wiper blades 22. The creation of two wiper blades 22 reduces spring 6 stress and provides redundancy in the event one of the blades 22 fail, improving the overall reliability of the grounding pin 2. The width of one of the wiper blades 22 should be larger than the width of the other wiper blade 22, to ensure that the wiper blades 22 do not have the same resonant frequency.

The post 4 should be made of an electrically conductive material for minimum resistance and have a lead in chamfer 24 at the receptive end. The post 4 may be one continuous cylinder, FIG. 2, or have a cut out tongue area 26, FIG. 1. The tongued post 26 together with a semi-circular second aperture 28, see FIG. 5*a*, provides connector polarization to prevent a male connector shell 8 from mating with an electrically incompatible female connector shell 14. To provide further polarization the post collar 10 may have a hexagonal shape which matches with a hexagonal recess 30 in the male connector shell 8 to allow six different orientations of the grounding pin 2, see FIG. 6. When the hexagonal collar 10 sits within the hexagonal recess 30, the male connector shell 8 prevents the post 4 from rotating. The male connector 8 will only mate with a female connector 14 having a semi-circular aperture 28 that has the same orientation as the tongue 26 of the post 4.

What is claimed is:

1. A grounding pin that provides an electrical path between the shells of mated connectors, wherein the grounding pin is retained by a male connector shell and a mating female connector shell has a pin receiving aperture, comprising:

(a) a post, and (b) a spring attached to said post, for pushing said post into contact with said connector shells, when said post and said spring are received by said female connector shell aperture.

2. The grounding pin as recited in claim 1 wherein said spring is a flexible strip with a outwardly convex portion at one end.

3. The grounding pin as recited in claim 2 wherein said spring has two wiper blades at the convex portion of said spring.

4. The grounding pin as recited in claim 3 wherein the width of one wiper blade is larger than the width of the other wiper blade.

5. The grounding pin as recited in claim 4 wherein said post has a collar which is encapsulated by said male connector shell, whereby said post is retained by said male connector shell.

6. The grounding pin as recited in claim 1 wherein the end of said post that engages with said female connector shell aperture includes a polarizing tongue.

7. The grounding pin as recited in claim 6 wherein said spring is a flexible strip with a outwardly convex portion at one end.

8. The grounding pin as recited in claim 7 wherein said spring has two wiper blades at the convex portion of said spring.

9. The grounding pin as recited in claim 8 wherein the width of one wiper blade is larger than the width of the other wiper blade.

10. The grounding pin as recited in claim 9 wherein said post has a collar which is encapsulated by said male connector shell, whereby said post is retained by said male connector shell.

11. The grounding pin as recited in claim 10 wherein said post has a polarizing hexagonal collar which sits in an hexagonal recess of said male connector shell and is encapsulated by said male connector shell, whereby said male connector shell retains said post and prevents said post from rotating.

* * * * *